US008128452B2

(12) United States Patent
Kim et al.

(10) Patent No.: US 8,128,452 B2
(45) **Date of Patent: *Mar. 6, 2012**

(54) BUILDING BLOCK

(75) Inventors: Jong Sung Kim, Incheon (KR); Kyoung Woon Song, Seongnam-si (KR)

(73) Assignee: Edtoy Co., Ltd., Bupyeong-Gu, Incheon (KR)

( * ) Notice: Subject to any disclaimer, the term of this patent is extended or adjusted under 35 U.S.C. 154(b) by 140 days.

This patent is subject to a terminal disclaimer.

(21) Appl. No.: 12/647,241

(22) Filed: Dec. 24, 2009

(65) Prior Publication Data

US 2010/0159794 A1 Jun. 24, 2010

Related U.S. Application Data

(63) Continuation-in-part of application No. 12/408,132, filed on Mar. 20, 2009, which is a continuation-in-part of application No. 12/402,742, filed on Mar. 12, 2009, now Pat. No. 7,985,116, which is a continuation-in-part of application No. 12/440,933, filed as application No. PCT/KR2007/004248 on Sep. 4, 2007, now Pat. No. 7,988,518.

(30) Foreign Application Priority Data

Sep. 13, 2006 (KR) ..... 10-2006-0088369

(51) Int. Cl.
*A63H 33/26* (2006.01)

(52) U.S. Cl. ..... 446/92; 446/129

(58) Field of Classification Search ..... 446/71, 446/72, 85, 92, 129, 131, 134, 135, 137, 446/138, 168; 273/155, 156
See application file for complete search history.

(56) References Cited

U.S. PATENT DOCUMENTS

| | | | | |
|---|---|---|---|---|
| 2,665,913 | A * | 1/1954 | Hlavac | 273/239 |
| 2,970,388 | A | 2/1961 | Yonkers | 35/18 |
| 5,152,711 | A | 10/1992 | Gross | 446/139 |
| 6,048,248 | A * | 4/2000 | Ritchey | 446/71 |
| 6,749,480 | B1 * | 6/2004 | Hunts | 446/92 |
| 6,846,216 | B1 | 1/2005 | Balanchi | 446/85 |
| 6,969,294 | B2 | 11/2005 | Vicentelli | 446/92 |
| 7,413,493 | B2 * | 8/2008 | Toht et al. | 446/92 |
| 2004/0116038 | A1 | 6/2004 | Hunts | 446/92 |
| 2006/0111010 | A1 * | 5/2006 | Park | 446/92 |
| 2006/0240737 | A1 | 10/2006 | Yoon | 446/92 |
| 2007/0287353 | A1 | 12/2007 | Vicentelli | 446/92 |

FOREIGN PATENT DOCUMENTS

JP 09-140855 6/1997

(Continued)

OTHER PUBLICATIONS

International Search Report dated Dec. 21, 2007.

(Continued)

*Primary Examiner* — Nini Legesse
(74) *Attorney, Agent, or Firm* — Ked & Associates LLP

(57) ABSTRACT

A block for building is provided. The block may include a body, a case provided in the body, a holder movably provided within the case, and a magnet installed in the holder. The holder may include a sliding prevention part to provide for engagement with adjacent blocks together with the magnet. Adjacent blocks having such a construction may connect to each other to build a plurality of figures without movement of the blocks relative to each other.

12 Claims, 9 Drawing Sheets

FOREIGN PATENT DOCUMENTS

| | | | |
|---|---|---|---|
| KR | 10-2004-0065186 | | 7/2004 |
| KR | 20-0404030 | | 12/2005 |
| KR | 10-0841960 | | 6/2008 |
| WO | WO 2006/112679 | A1 | 10/2006 |

OTHER PUBLICATIONS

U.S. Office Action issued in U.S. Appl. No. 12/408,132 dated Mar. 24, 2011.

Office Action dated Oct. 21, 2010 issued in U.S. Appl. No. 12/440,933.

European Search Report dated Jul. 28, 2010 issued in Application No. 10002520.4-2318.

International Search Report dated Dec. 21, 2007.

* cited by examiner

BUILDING BLOCK

This application is a Continuation-In-Part of U.S. patent application Ser. No. 12/408,132 filed Mar. 20, 2009, which is a Continuation-In-Part of U.S. patent application Ser. No. 12/402,742 filed Mar. 12, 2009 now U.S. Pat. No. 7,985,116, which is a Continuation-In-Part of U.S. patent application Ser. No. 12/440,933 filed Mar. 12, 2009 now U.S. Pat. No. 7,988,518, which is the National Stage Application of PCT/KR2007/004248 filed Sep. 4, 2007, which claims priority to Korean Patent Application No. 10-2006-0088369, filed in Korea on Sep. 13, 2006, whose entire disclosures are incorporated herein by reference.

BACKGROUND

1. Field

This relates to a block for building a figure.

2. Background

Building blocks may be connected to each other to build a figure, such as, for example, a toy, separated from each other to disassemble such a figure/toy, and re-connected in a different arrangement to build a different figure/toy. Improvements in the devices that connect building blocks would be advantageous.

BRIEF DESCRIPTION OF THE DRAWINGS

Embodiments will be described in detail with reference to the following drawings in which like reference numerals refer to like elements wherein.

DETAILED DESCRIPTION

One type of block for building a figure, such as, for example, a toy may include male and female connection parts so that the male connection part of a first block may be inserted into the female connection part of a second block to connect the first and second blocks.

Other types of blocks for building a figure, such as a toy may be equipped with rotatable magnets, each having south and north pole faces. The south pole face of the magnet installed in a first block connects to the north pole face of the magnet installed in a second block or vice versa to connect the first and second blocks. Because the magnets are rotatable, when the outside faces of magnets in the first and second blocks happen to have like poles, one of the magnets may rotate so that the magnets have unlike poles.

The magnet may be installed in a case and have two spindles protruding from its opposite lateral sides, and a body of the block may have two opposite holes formed in its inner wall so as to respectively receive the two spindles. The case may be rotatable with the two spindles respectively inserted into the two corresponding holes. However, particles may be trapped between the spindles and inner surfaces of the holes, thereby preventing the case from smoothly rotating.

The blocks may also include alternate protrusions and indentations on the contact surfaces. When the first and second blocks are connected to each other by magnetic force, the protrusions on the contact surface of the first block may fit into the indentations on the contact surface of the second block to prevent the blocks from sliding relative to each other. However, the protrusions and indentations may be subject to damage, and a user may be injured by the protrusions. Further, it may be difficult to form the alternate protrusions and indentations on the contact surface of a block that is made of wood.

Figure 1:
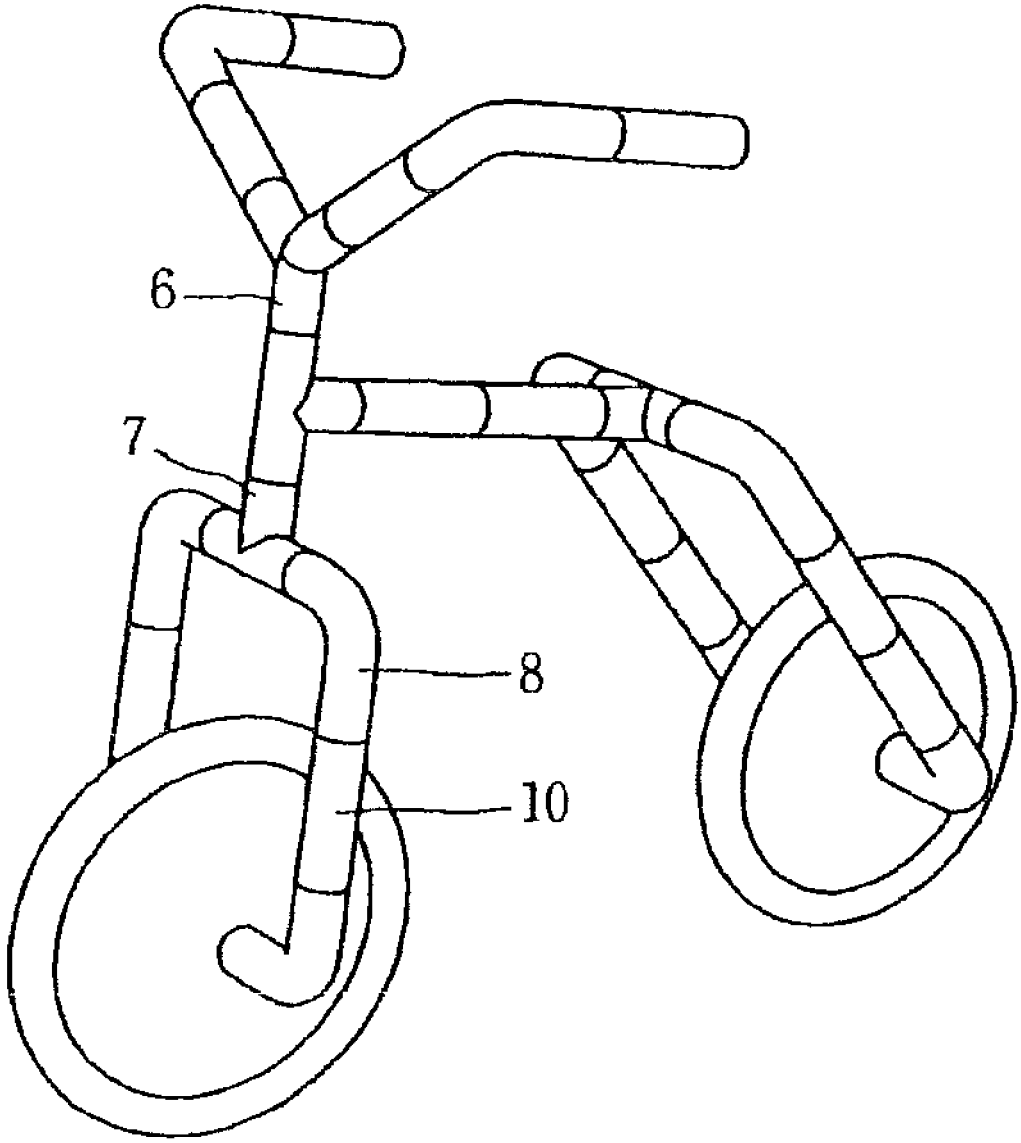
FIG. 1 illustrates an exemplary bicycle-shaped toy built with blocks according to an embodiment as broadly described herein.
Figure 2A:
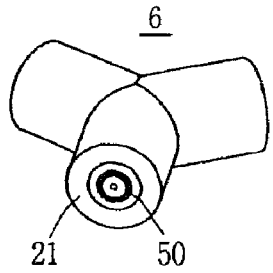
FIGS. 2A-2D illustrate exemplary blocks which may be used to build the bicycle-shaped toy shown in FIG. 1.
Figure 2B:
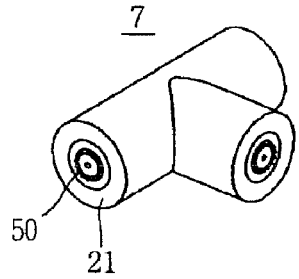
Figure 2C:
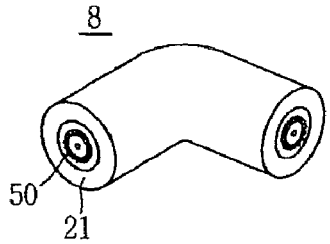
Figure 2D:
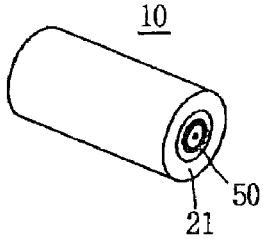

The exemplary bicycle-shaped toy shown in FIG. 1 may be built by connecting a contact surface 21 of a first block to a contact surface 21 of a second block using a magnetic force generated between unlike pole faces of two magnets 50 respectively provided in the first and second blocks. The blocks 6, 7, 8, and 10 shown in FIGS. 1-2D are exemplary in nature, and may be used in building the exemplary bicycle-shaped figure shown in FIG. 1, or other figures as desired. The blocks 6, 7, 8, and 10 may have similar construction, but different body shape. Therefore, detailed descriptions of the individual blocks 6, 7, and 8 will be omitted, and the block 10 shown in FIG. 2D will be described in detail, simply for ease of discussion.

Figure 3:
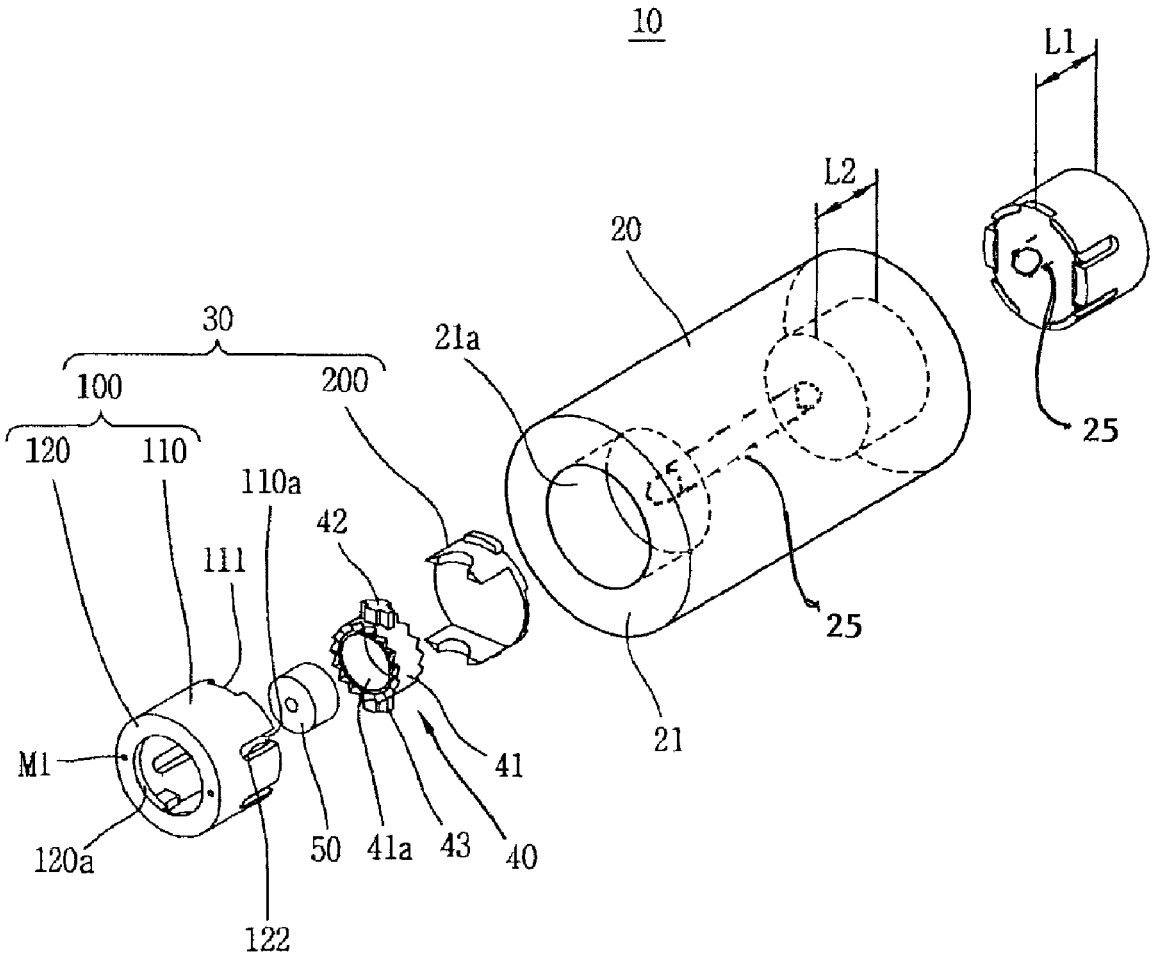
FIG. 3 is a disassembled perspective view of the block shown in FIG. 2D.

As shown in FIG. 3, the block 10 according to embodiment as embodied and broadly described herein may include a body 20, a case 30, a holder 40, and a magnet 50.

In the embodiment shown in FIG. 3, body 20 is substantially cylindrical. However, the body 20 may have a variety of different shapes. For example, the body 20 may be in the shape of a doll/action figure/animal or some portion thereof. In certain embodiments, the body 20 may be made of wood, metal or a hard plastic material. In alternative embodiments, body 20 may be formed by sewing fabric into a shell and filling the fabric shell with an appropriate filler. In alternative embodiments, the shell may be made of for example, a woven/textile material, a pliable plastic material such as vinyl, a leather material, or other material as appropriate. The body 20 may include a hole 21A in the contact surface 21 thereof.

The case 30 may fit into the hole 21A in the contact surface 21 such that the case 30 is held firmly in place in the hole 21A. Alternatively, the case 30 may be held firmly in place in the hole 21A with an adhesive or other appropriate bonding agent. The length L1 of the case 30 may be substantially the same as the depth L2 of the hole 21A to prevent the case 30 from protruding from the hole 21A. As a result, when the blocks connect to each other, the contact surfaces 21 of the blocks come in contact so as to flush with each other.

In certain embodiments, a hole 25 may extend lengthwise through the body 20 from the bottom of the hole 21A. The hole 25 may extend into the magnet 50 and the case 30. Such holes 25 in the body 20, the case 30, and the magnet 50 may provide a passage through which a glass bead may roll or a liquid may flow. The body 20 may be made of a transparent material, so that the glass bead or the liquid rolling or flowing through the passage defined by the hole 25 is visible.

Figure 4:
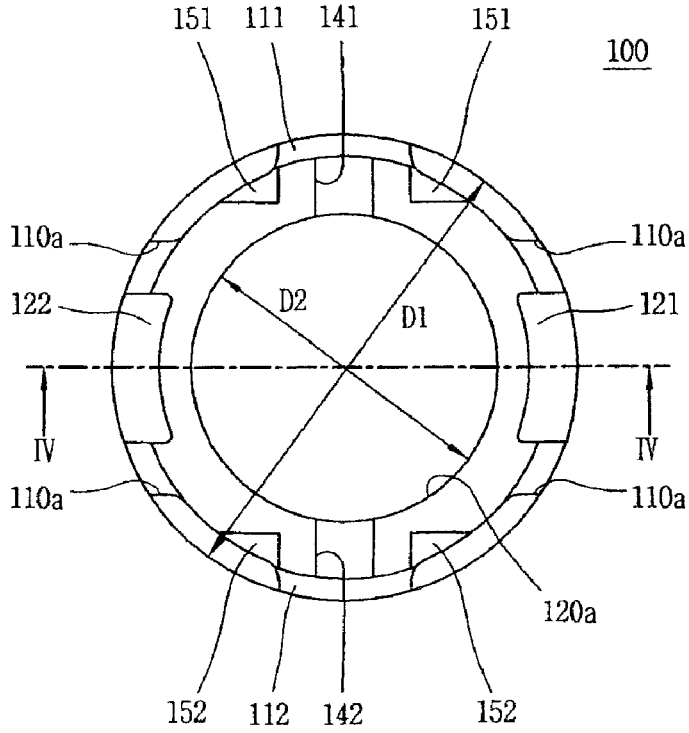
FIG. 4 is a rear view of a first case of the block shown in FIG. 3.
Figure 5:
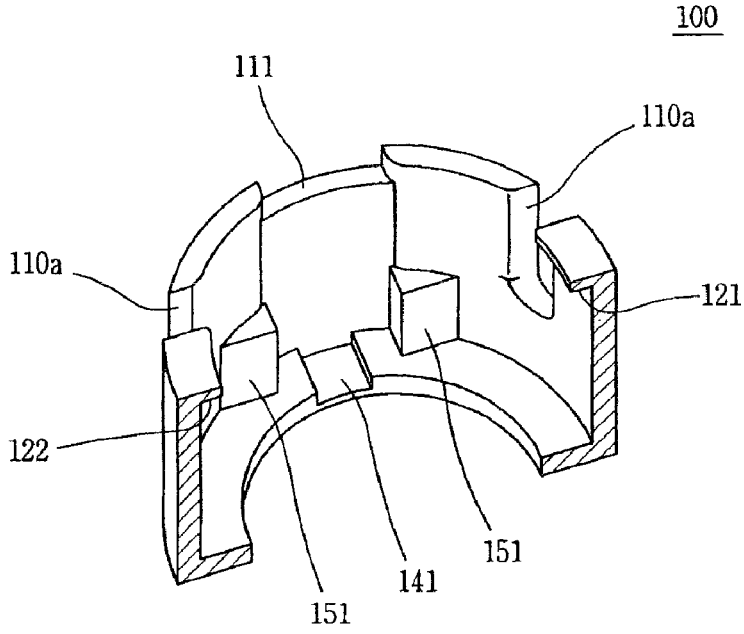
FIG. 5 is a vertical cross-sectional view taken along line IV-IV of the first case shown in FIG. 4.

As shown in FIG. 3, the case 30 may include a first case 100 and a second case 200. As shown in FIGS. 3 through 5, the first case 100 may include a case body 110 and a case cover 120 that covers a front portion of the case body 110. The case body 110 may be substantially cylindrical and have first and second protrusions 121 and 122 formed opposite each other at an end thereof. The first and second protrusions 121 and 122 may protrude horizontally inward from a lateral side of the case body 110.

Two slots 110A may be formed in the lateral side of the case body 110, with the first protrusion 121 positioned therebetween, to allow the first protrusion 121 to move back and forth. Two additional slots 110A may be formed in the lateral side of the case body 110 with the second protrusion 122 positioned therebetween, to allow the second protrusion 122 to move back and forth. The case body 110 may include first and second openings 111 and 112 provided opposite each other at the end of the case body 110. The first and second openings 111 and 112 may be formed as recesses in the lateral wall and may be spaced a given distance from the first and second protrusions 121 and 122.

The case cover 120 may be substantially circular and may include a hole 120A in the middle. The diameter D2 of the hole 120A may be less than the outer diameter D1 of the case body 110, and may receive a holder body 41 of the holder 40 therein. Reference points M1 may be marked on the front of the case cover 120, at opposite ends of a line passing through the center point of the hole 120A.

Figure 9:
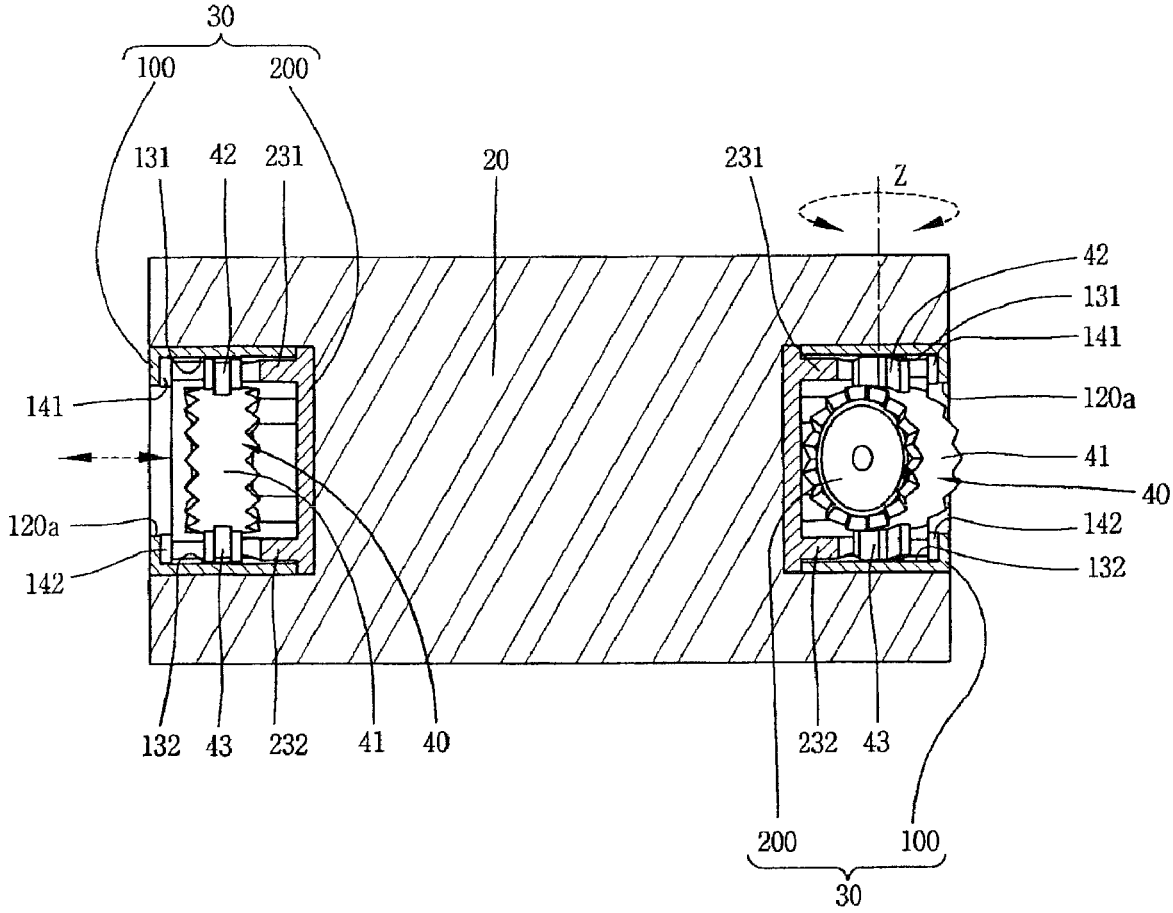
FIG. 9 illustrates a motion and rotation of the holder within the case.

The case cover 120 may include first and second spindle pockets 141 and 142 formed opposite each other at a rear portion of the case cover 120. First and second spindles 42 and 43 of the holder 40 may be inserted into the first and second spindle pockets 141 and 142, respectively. The case 30 may also include first and second front protrusions 151 and 152 which protrude from the rear of the case cover 120 and the lateral side of the case body 110. The two first front protrusions 151 may be behind the first spindle pocket 141 and opposite each other with the first spindle pocket 141 positioned therebetween. The two first front protrusions 151 form the front section of a first longitudinal pocket 131 as shown in FIG. 9. The two second front protrusions 152 are behind the second spindle pocket 142 and opposite each other with the second spindle pocket 142 positioned therebetween. The two second front protrusions 152 form the front section of a second longitudinal pocket 132 as shown in FIG. 9.

Figure 6:
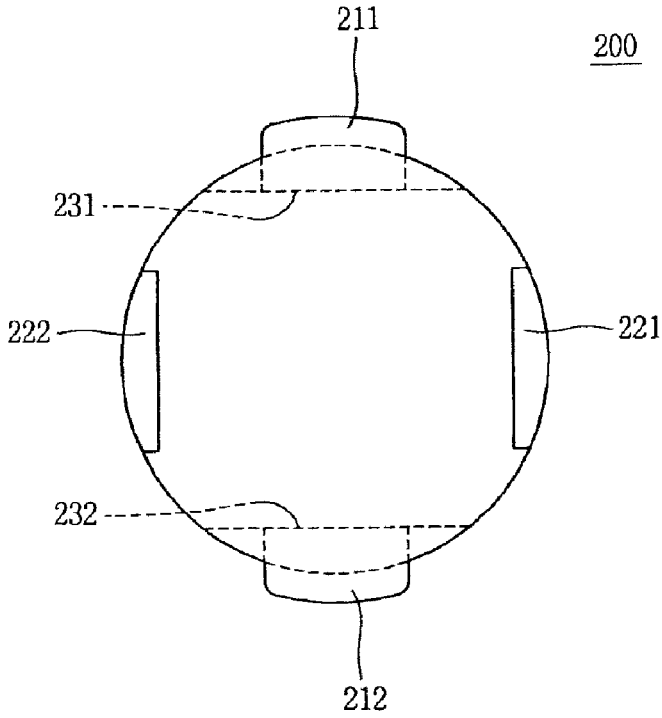
FIG. 6 is a top view of a second case shown in FIG. 3.
Figure 7:
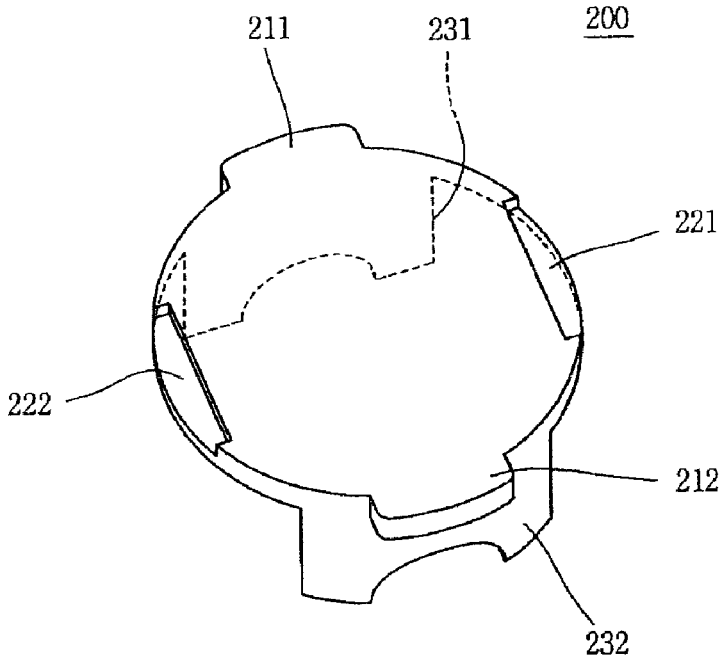
FIG. 7 is a perspective view of the second case shown in FIG. 3.

As shown in FIGS. 6 and 7, the second case 200 may include first and second indentations 221 and 222 formed opposite each other in an external surface thereof. The first and second protrusions 121 and 122 may be respectively inserted into the first and second indentations 221 and 222.

The second case 200 may also include first and second connection protrusions 211 and 212 formed opposite each other at a lateral side thereof. The first and second connection protrusions 211 and 212 protrude horizontally outward from the lateral side of the second case 200. The first and second connection protrusions 211 and 212 may be respectively inserted into the first and second openings 111 and 112, or recesses, as shown in FIG. 4.

The second case 200 may also include first and second rear protrusions 231 and 232 formed opposite each other so as to protrude downward from the rear side of the second case 200. The first rear protrusion 231 defines the rear section of the first longitudinal pocket 131, and the second rear protrusion 232 defines the rear section of the second longitudinal pocket 132, as shown in FIG. 9. When the first and second cases 100 and 200 are coupled, the first front protrusion 151 and the first rear protrusion 231, and the second front protrusion 152 and the second rear protrusion 232 form the first and second longitudinal pockets 131 and 132, respectively, as shown in FIG. 9.

As shown in FIGS. 4 through 7, the first and second cases 100 and 200 may be coupled to each other by inserting the first and second protrusions 121 and 122 into the first and second indentations 221 and 222, respectively. At this point, the first and second connection protrusions 211 and 212 are inserted into the first and second openings 111 and 112, respectively. This prevents the second case 200 from rotating on its own axis.

Figure 8:
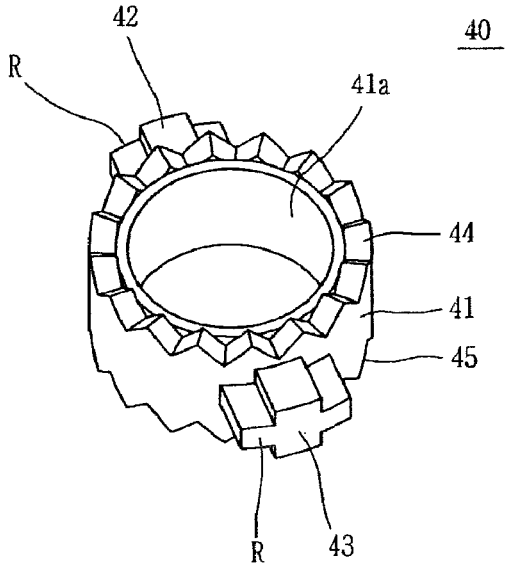
FIG. 8 is a perspective view of a holder shown in FIG. 3.

As shown in FIG. 8, the holder 40 may include a holder body 41, a first spindle 42, a second spindle 43, and a sliding-prevention part. The outer periphery of the holder body 41 may be substantially circular. The holder body 41 may include a hole 41A formed in the middle so as to receive a magnet 50 therein. The magnet 50 may be fitted and held firmly in place in the hole 41A, or may be held firmly in place in the hole 41A by an adhesive or other appropriate bonding agent. The holder 40 may be made of a molded plastic material such that it encircles an outer edge of the magnet 50, or it enclose an entire body of the magnet 50. The first and second spindles 42 and 43 may be provided opposite each other on the outer circumferential surface of the holder body 41.

As shown in FIG. 9, the holder 40 may be movably and rotatably installed within the case 30. Two dotted-line arrows indicate the directions in which the holder 40 moves and rotates within the case 30.

The holder 40 moves within the case 30, with the respective ends of the first and second spindles 42 and 43 being supported by the first and second longitudinal pockets 131 and 132. That is, the first and second longitudinal pockets 131 and 132 guide motions of the first and second spindles 41 and 42. The holder 40 may move backward until the first and second spindles 42 and 43 are blocked by the first and second rear protrusions 231 and 232, respectively, and may move forward until the first and second spindles 42 and 43 arrive at the bottoms of the first and second spindle pockets 141 and 142, respectively.

The holder 40 may rotate about the center line Z within the case 30, with the respective ends of the first and second spindles 42 and 43 being inserted into the first and second longitudinal pockets 131 and 132. As shown in FIG. 8, the ends of the first and second spindles 42 and 43 may be rounded so as to facilitate rotation of the holder 40.

Figure 10:
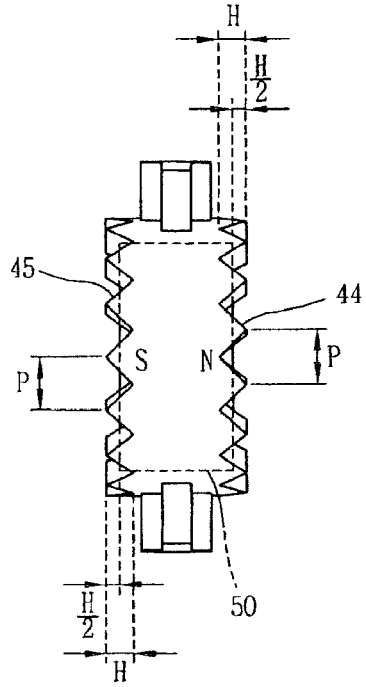
FIG. 10 illustrates a magnet installed within the holder.

As shown in FIG. 10, the sliding-prevention part may include a plurality of first teeth 44 and a plurality of second teeth 45. The first teeth 44 may be provided on the front of the holder body 41, and the second teeth 45 may be provided on the rear of the holder body 41.

The first teeth 44 and the second teeth 45 may be substantially the same in pitch and depth H. The first teeth 44 and the second teeth 45 may be phase-shifted relative to each other by 180 degrees. The thickness of the magnet 50 may be such that one pole face of the magnet 50 is positioned at half of the depth of the first teeth 44, and the other pole face of the magnet 50 is positioned at half of the depth of the second teeth 45.

Figure 11:
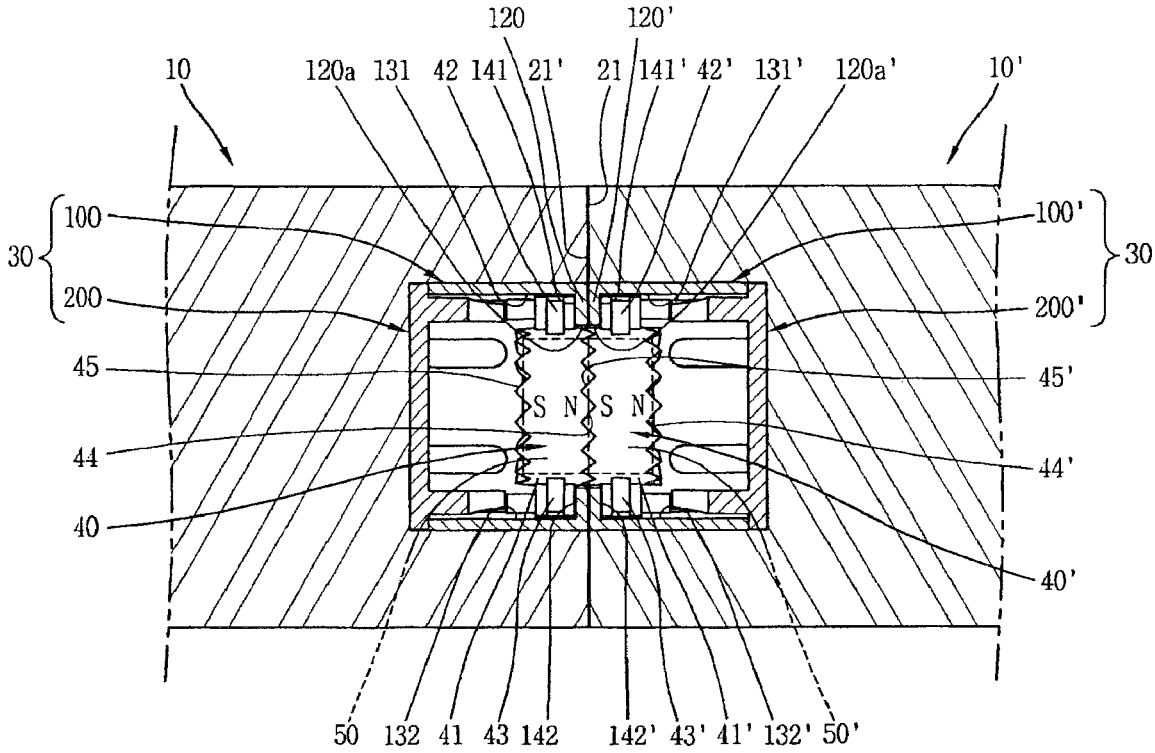
FIG. 11 illustrates a contact surface of a first block in contact with a contact surface of a second block.

As a result, as shown in FIG. 11, the first teeth 44 in the first block 10 and the second teeth 45' in the second block 10' may mesh properly when the first and second blocks 10 and 10' connect to each other. The contact surface 21 of the first block 10 and the contact surface 21' of the second block 10', as well as the magnets 50 and 50' of the first and second blocks 10 and 10', may come into contact and be flush with each other. This prevents the first and second blocks 10 and 10' from sliding with respect to each other.

The magnet 50 may be substantially circular and may have south and north pole faces. Such a circular magnet having south and north pole faces may be more cost-effective compared to a magnet having two or more poles on one face.

Figure 12:
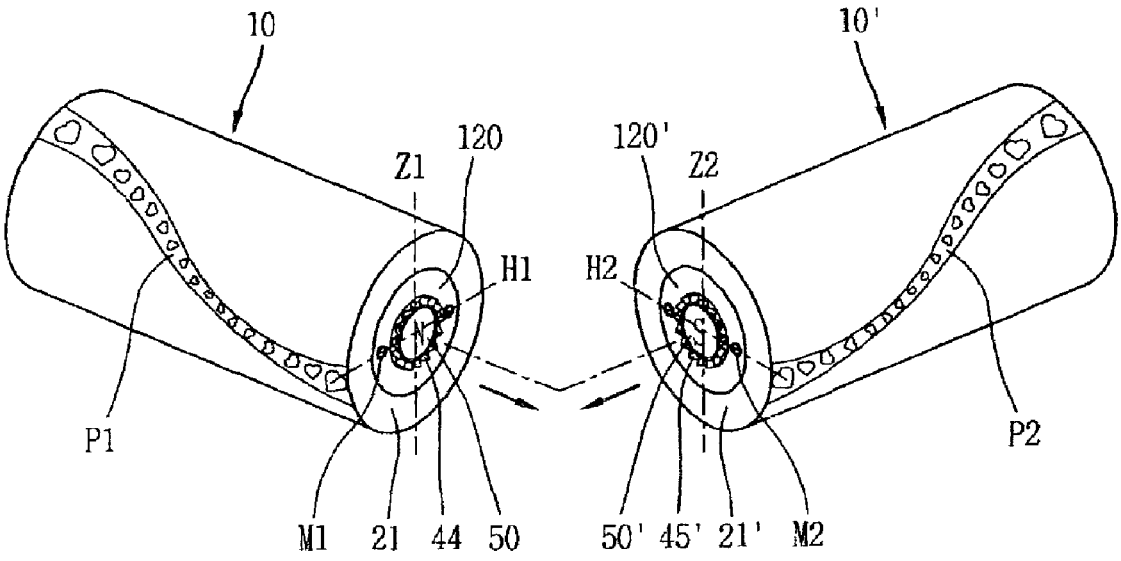
FIG. 12 illustrates exemplary embellishments on the first and second blocks.

FIG. 12 illustrates first and second blocks 10 and 10' having respective embellishments/decoration on the body. When the blocks 10 and 10' connect to each other, the two embellishments on the blocks 10 and 10' connect to each other to form a continuous decoration. The embellishments on the first and second blocks 10 and 10' may be paintings P1 and P2, as shown in FIG. 12, or other forms of decoration as appropriate.

The two reference points M1 are marked on the front of the case cover 120 on the first block 10. The two reference points M1 are at opposite ends of the line H1 passing through the center point of the case cover 120. The line H1 connecting the two reference points M1 is perpendicular to a center line Z1 about which the holder 40, as shown in FIG. 11, rotates.

Two reference points M2 are marked on the front of the case cover 120' of the second block 10', on the line H2 passing through the center point of the case cover 120'. The line H2 connecting the two reference points M2 is perpendicular to a center line Z2 about which the holder 40', as shown in FIG. 11, rotates.

When the reference points M1 and M2 overlap with each other, the paintings P1 and P2 precisely connect to each other, and unlike pole faces of the magnets 50 and 50' in the first and second blocks 10 and 10' also connect to each other. At this point, the first teeth 44 in the first block 10 and the second teeth 45' in the second block 10' mesh properly, and the contact surface 21 of the first block 10 and the contact surface 21' of the second block 10' contact with each other.

Figure 13A:
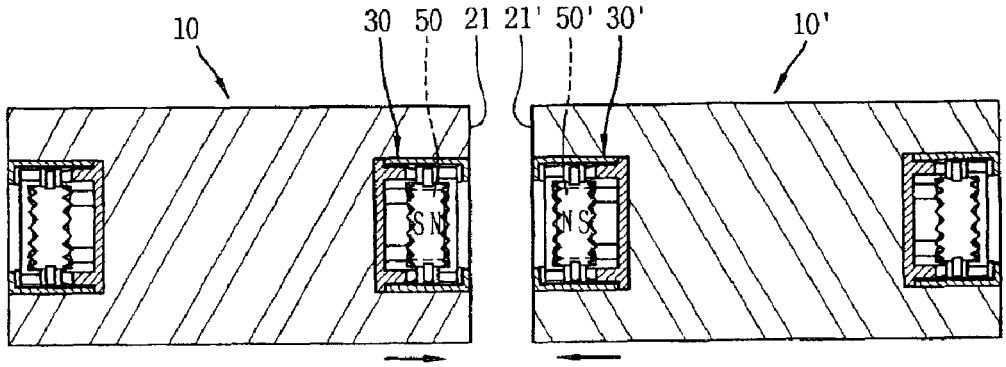
FIGS. 13A-13C illustrate a connection sequence of the first and second blocks.
Figure 13B:
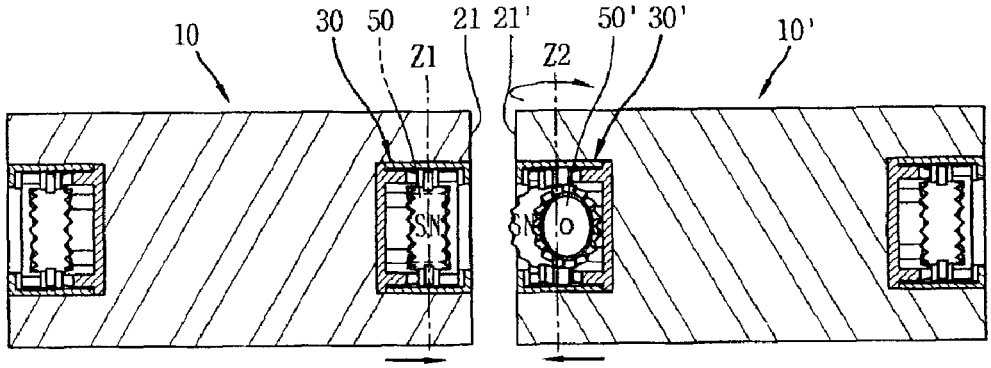
Figure 13C:
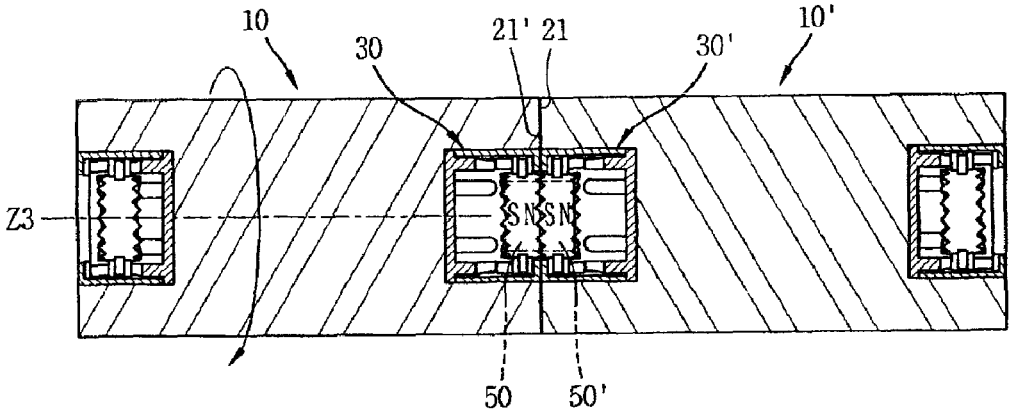

FIGS. 13A-13C illustrate the order in which the first and second blocks 10 and 10' connect to each other.

As shown in FIG. 13A, the first and second blocks 10 and 10' move towards each other for connection. For purposes of discussion, it is assumed that an outside face of the magnet 50 in the first block 10 has a north pole and an outside face of the magnet 50' in the second block 10' also has a north pole.

As shown in FIG. 13B, the magnet 50' in the second block 10' rotates about the center line Z2, because like pole faces repel each other. After this rotation, the outside face of the magnet 50' has a south pole. Alternatively, the magnet 50 in the first block 10 may rotate about the center line Z1 so that the outside face of the magnet 50 has a south pole. In either instance, as a result of the rotation of one of the magnets 50 or 50', the outside faces of the magnets 50 and 50' have unlike poles. The magnets 50 and 50' attract each other, thereby connecting the blocks 10 and 10'.

If the outside faces of the magnets 50 and 50' already are positioned so that they have unlike poles facing each other, neither of the magnets 50 and 50' has to rotate. The magnets 50 and 50' attract each other as they are, thereby connecting the blocks 10 and 10'.

As shown in FIGS. 11 and 13C, when the first and second blocks 10 and 10' connect to each other, the holder body 41 of the holder 40 is inserted into the hole 120A in the case cover 120 on the first case 100 in the first block 10. At the same time, the first and second spindle 42 and 43 are inserted into the first and second spindle pockets 141 and 142, respectively. The holder body 41' of the holder 40' is inserted into the hole 120A' in the case cover 120' on the first case 100' in the second block 10', and, at the same time, the first and second spindle 42' and 43' are inserted into the first and second spindle pockets 141' and 142', respectively.

The magnets 50 and 50' of the first and second blocks 10 and 10' connect to each other, causing the first teeth 44 in the first block 10 and the second teeth 45' in the second block 10' to mesh properly. The holder 40 cannot rotate itself because the first and second spindles 42 and 43 fit into the first and second spindle pockets 141 and 142, respectively, and therefore are held essentially unmovable. The holder 40' cannot rotate itself because the first and second spindles 42' and 43' fit into the first and second spindle pockets 141' and 142', respectively, and therefore are held essentially unmovable.

The first and second blocks 10 and 10' can rotate about the axis Z3 in opposite directions while they remain in contact with each other. As shown in FIG. 13C, for example, when the first block 10 rotates about Z3 in the direction in which the solid-line arrow indicates, the first teeth 44 in the first block 10 can go over the second teeth 45' in the second block 10' while the first teeth 44 and the second teeth 45' mesh properly. At this point, a frictional sound is produced between the first teeth 44 and the second teeth 45'.

A block for building a toy is provided that is capable of connecting to another block of the same construction, without sliding off with respect to each other, by enabling outside faces of magnets on the blocks to have unlike poles.

A block for building a toy is provided, having a sliding-prevention part being positioned inside a body of the block and being capable of connecting to another block of the same construction, without sliding off with respect to each other, by enabling outside faces of magnets of the blocks to have unlike poles.

A block for building a toy as embodied and broadly described herein may include a body, a case installed in the body, a holder with a sliding-prevention part, movable and rotatably provided within the case, and a magnet with south and north pole faces, installed in the holder.

In certain embodiments, free rotation of the holder within the case may enable outside faces of the magnets in the blocks to have unlike poles. This makes it possible to connect the blocks, as they are, without having to change their current positions.

In certain embodiments, the holder may rotate with two opposite spindles protruding from its outside circumferential surface being located within corresponding two longitudinal pockets such that the two spindles function as an axis about which the holder rotates. The longitudinal pockets are wide enough so that the spindles can freely move and rotate within it although particles are trapped between the spindles and the inside walls of the longitudinal pockets. Accordingly, the holder rotates without a hitch.

In alternative embodiments, the sliding-prevention part may be provided on the holder instead of on the body. This locates the sliding-prevention part inside the body, thereby eliminating the need for providing the sliding-prevention part on the body. That is, the sliding-prevention part is hidden inside the body. As a result, a limitation to use of a material of the body is overcome. Furthermore, the sliding-prevention part is prevented from causing possible damage to itself and the human body.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A building block, comprising:

a body;

at least one case installed in the body;

at least one holder movably installed within the at least one case, the at least one holder including:

a holder body;

first and second spindles provided opposite to each other at outer circumferential surface portions of the holder body;

a first plurality of teeth provided on a first face of the holder body oriented toward an exterior of the building block; and a second plurality of teeth provided on a second face of the holder body opposite to the first face, wherein the first and second plurality of teeth have substantially a same pitch and depth; and at least one magnet installed in the at least one holder, the at least one magnet including north and south pole faces, wherein the body comprises a shell into which fabric is sewn, and wherein the fabric shell is filled with a filler.

2. The building block of claim 1, wherein the holder is configured to move longitudinally and to rotate within the at least one case.

3. The building block of claim 1, wherein the at least one magnet is fitted within a hole formed in a central portion of the holder body, and wherein ends of the first and second spindles are rounded.

4. The building block of claim 3, wherein the at least one case comprises:

a first case, comprising a case body and a case cover that covers a first end of the case body facing an exterior of the building block; and a second case coupled to the first case.

5. The building block of claim 4, wherein two reference points are marked on an exposed surface of the case cover facing an exterior of the building block such that a first line connecting the two reference points passes through a center point of the case cover and extends perpendicular to a second line about which the at least one holder rotates.

6. The building block of claim 4, wherein the case cover has an opening formed at a central portion thereof, and wherein the case body has first and second recesses and first and second protrusions formed at a second end thereof opposite the first end.

7. The building block of claim 6, wherein the second case is coupled to the second end of the case body, and wherein the second case has first and second indentations formed in a first end thereof oriented toward an interior of the building block, wherein the first and second protrusions are, respectively, received in the first and second indentations, and wherein the second case has first and second connection protrusions formed on an outer circumferential portion of the first end, which are respectively received in the first and second recesses.

8. The building block of claim 4, further comprising:

first and second spindle pockets provided opposite to each other in interior side portions of the case cover, wherein the first and second spindles are, respectively, received in the first and second spindle pockets;

first and second front protrusions that protrude from an interior side of the case cover and a lateral interior side of the case body, with the first and second spindle pockets positioned respectively therebetween; and first and second rear protrusions provided opposite each other that each extend from a first end of the second case to a second end of the second case.

9. The building block of claim 8, wherein the first and second front protrusions form front sections of first and second longitudinal pockets, and wherein the first and second rear protrusions form rear sections of the first and second longitudinal pockets.

10. The building block of claim 9, wherein the first and second spindles are configured to rotate and move longitudinally within the first and second longitudinal pockets, respectively, so as to move the holder longitudinally and rotate the holder within the case.

11. The building block of claim 1, wherein the first plurality of teeth are configured to engage with a second plurality of teeth of an adjacent building block, and wherein the second plurality of teeth are configured to engage with a first plurality of teeth of an adjacent building block, based on an orientation of north and south pole faces of adjacent magnets so as to engage adjacent holders of adjacent building blocks.

12. The building block of claim 1, wherein a thickness of the at least one magnet is such that a first pole face of the at least one magnet is positioned at half of a depth of the first plurality of teeth and a second pole face of the at least one magnet is positioned at half of a depth of the second plurality of teeth.

* * * * *